US009709354B2

(12) United States Patent
Larue

(10) Patent No.: US 9,709,354 B2
(45) **Date of Patent: *Jul. 18, 2017**

(54) SUPPRESSOR AND FLASH HIDER DEVICE FOR FIREARMS HAVING DUAL PATH GAS EXHAUST

(71) Applicant: Mark C. Larue, Leander, TX (US)

(72) Inventor: Mark C. Larue, Leander, TX (US)

( * ) Notice: Subject to any disclaimer, the term of this patent is extended or adjusted under 35 U.S.C. 154(b) by 119 days.

This patent is subject to a terminal disclaimer.

(21) Appl. No.: 14/811,257

(22) Filed: Jul. 28, 2015

(65) Prior Publication Data

US 2017/0030672 A1 Feb. 2, 2017

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/00; F41A 21/30; F41A 21/28; F41A 21/32; F41A 21/325; F41A 21/34
USPC ..... 89/14.4
See application file for complete search history.

(56) References Cited

U.S. PATENT DOCUMENTS 1,017,003 A * 2/1912 Kenney ..... F41A 21/30 181/223
3,786,895 A * 1/1974 Perrine ..... F01N 1/003 181/223
5,164,535 A * 11/1992 Leasure ..... F41A 21/30 181/223
6,575,074 B1 * 6/2003 Gaddini ..... F41A 21/34 89/14.4
7,832,323 B1 * 11/2010 Davies ..... F41A 21/30 89/14.4
7,874,238 B2 * 1/2011 Silvers ..... F41A 21/30 181/223
8,807,272 B2 * 8/2014 Bladen ..... F41A 21/30 181/223
8,844,422 B1 * 9/2014 Klett ..... F41A 21/34 89/14.2
8,967,325 B1 * 3/2015 Cronhelm ..... F41A 13/00 181/223
9,500,427 B1 * 11/2016 Wu et al. ..... F41A 21/30
2010/0180759 A1 * 7/2010 Petersen ..... F41A 21/30 89/14.4
2011/0220434 A1 * 9/2011 Silvers ..... F41A 21/30 181/223
2013/0319790 A1 * 12/2013 Bladen ..... F41A 21/30 181/223

(Continued)

*Primary Examiner* — Michelle R Clement
(74) *Attorney, Agent, or Firm* — James L. Jackson

(57) ABSTRACT

A suppressor and flash hider device for firearms defines primary and secondary propellant gas paths that function simultaneously to quickly decrease gas pressure within the tubular housing of the suppressor to minimize blow-back toward the firearm user. The tubular housing has a collet-like firearm clamping system that establishes symmetrical clamping that will not tend to force the suppressor off coaxial alignment with the firearm barrel to which is mounted. A front wall mounted to the housing defines a central projectile port through which propellant gas also passes and defines an array of angularly oriented discharge passages for discharging propellant gases from the secondary propellant gas path forwardly and angularly toward gas being discharged from the projectile port of the front wall.

15 Claims, 5 Drawing Sheets

(56) References Cited

U.S. PATENT DOCUMENTS

| | | | | |
|---|---|---|---|---|
| 2014/0216237 | A1* | 8/2014 | Butler | F41A 21/30<br>89/14.4 |
| 2015/0267987 | A1* | 9/2015 | Gawencki | F41A 21/34<br>89/14.2 |
| 2015/0276340 | A1* | 10/2015 | Vais | F41A 21/30<br>181/223 |
| 2015/0292829 | A1* | 10/2015 | Pietila | F41A 21/30<br>181/223 |
| 2016/0209152 | A1* | 7/2016 | Dueck | B23K 26/282 |

* cited by examiner

SUPPRESSOR AND FLASH HIDER DEVICE FOR FIREARMS HAVING DUAL PATH GAS EXHAUST

BACKGROUND OF THE INVENTION

Field of the Invention

The present invention relates generally to noise and flash suppressors for firearms, particularly rifles, and more particularly concerns suppressors that are specifically designed to minimize the presence of residual propellant gas within a suppressor and rifle bore when the auto-loading mechanism of an auto-loading rifle initiates extraction of a spent cartridge case from the cartridge chamber of the rifle barrel. Even more specifically, this invention concerns minimization of the potential for residual propellant gas blow-back toward a firearm user by enhancing the volume of controlled discharge of propellant gas from noise and flash suppressors so that little if any residual propellant gas pressure is present within a firearm barrel at the time of cartridge case extraction by the auto-loading mechanism of a propellant gas energized firearm.

Description of the Prior Art

A significant number of firearm noise suppressor devices and flash suppressor devices, generally referred to as suppressors herein, have been developed over the years for use with firearms such as rifles and handguns. In most cases the suppressors are attached to the barrel of a firearm, such as by threaded attachment. In some cases suppressors are constructed integrally with a firearm barrel so as to be a permanent component of the firearm.

Typically, a suppressor comprises an elongate tubular body that attaches in any suitable manner to a firearm barrel and provides for the movement of a projectile from the bore of a firearm barrel and through the tubular body of the suppressor. To facilitate noise and flash suppression a number of internal baffles are typically positioned in stacked relation with baffle partitions disposed in axially spaced relation and with central openings in each baffle partition for projectile passage. A number of chambers that are defined between the internal baffles, causing the propellant gas to progress in serial fashion through each of the chambers. The partitions of the baffles are designed to reflect propellant gas and cause gas agitation within the chambers to slow the progress of gas transition through the suppressor and increase the dwell time and reduce the noise of the gas being exhausted from the suppressor. Propellant gas emitted from the bore of the barrel enters the much larger volume of the internal chamber of the tubular body and progresses in serpentine manner from chamber to chamber, with the gas expanding and its pressure being diminished within each successive chamber.

Suppressors are typically manufactured with threaded components which permit assembly and disassembly for cleaning of internal residue fouling and other service. When a suppressor device is releasably attached to a firearm barrel, repeated firing of the firearm typically causes continuous fouling of the baffles, chambers and threads of the suppressor by accumulation of cartridge powder residue. Thus, when the threads of the suppressor or the threads of a firearm barrel become fouled it may be difficult or impossible to remove clean and reassemble the components of a suppressor device. This undesirable characteristic is common to most types of suppressors and represents a distinct disadvantage when working with the firearm during field conditions. It often becomes necessary to return the firearm to a repair or service facility to clean away cartridge powder deposits. It is desirable therefore, to provide a suppressor mechanism that effectively ensures isolation of the threaded connections that secure the suppressor components in assembly and at the same time provide for effective stability and durability of the suppressor mechanism and its connection with a rifle barrel.

Another disadvantage of firearm suppressor use is the problem of suppressor instability and the potential for coaxial misalignment that results from the use of a threaded connection of the suppressor to the barrel of a firearm. The barrel of a firearm that is designed for attachment of a muzzle brake or suppressor is typically provided with a reduced diameter externally threaded section that is of fairly short length. An internally threaded section of a typical suppressor attachment end wall is fairly short, thus causing the threaded connection to have minimal stability due to the typical length of the threaded connection of the suppressor with the firearm barrel. It is desirable to provide a suppressor mechanism that is exceptionally stable as well as protecting the internal threaded components from the undesirable characteristics of gunpowder residue buildup and fouling. U.S. Pat. No. 8,511,425 of Mark C. LaRue shows a suppressor device that employs a flash hider type fitting as a structural interface with a tubular suppressor housing. The flash hider structure shown in the '425 patent has spaced, angulated external support surfaces that are in engagement with corresponding spaced internal surfaces of a housing mount. This feature adds materially to the structural integrity of the coupling mechanism for securing a suppressor to the threaded end of a firearm barrel.

Typical firearm noise suppressors have multiple compartments within a single elongate, typically cylindrical tubular housing and define a single gas flow path. The baffles that are spaced within the suppressor housing create back-pressure within the suppressor that is relatively slow to be exhausted to the atmosphere. In many cases some residual gas pressure will remain within a suppressor at the time the auto-cycling mechanism of a gas energized firearm causes unlocking of the bolt member and begins to extract a spent cartridge case from the cartridge chamber of the firearm. When this condition exists a small amount of the residual propellant gas may be released from the bore of the firearm due to the back-pressure within the suppressor when unseating of a cartridge case begins, thereby directing a small amount of residual propellant gas toward the user of the firearm. The presence of propellant gas can be objectionable from the standpoint of the comfort of the user. It is desirable, therefore, to provide a firearm noise and flash suppressor that provides for enhanced propellant gas exhaust to ensure optimum discharge of propellant gas and minimum gas exhaust dwell time so that little if any residual propellant gas pressure exists within the suppressor and firearm barrel when spent cartridge case extraction begins.

SUMMARY OF THE INVENTION

It is a principal feature of the present invention to provide a novel noise and flash suppressor mechanism for firearms that provides dual flow paths for propellant gas propagation through a suppressor, materially enhancing propellant gas flow and dissipation and ensuring against the presence of residual pressure in the suppressor and firearm barrel at the time spent cartridge case extraction is initiated.

It is another feature of the present invention to provide a novel noise and flash suppressor mechanism employing a collet-like support and alignment of suppressor connection structure establishing secure and stable connection of a tubular suppressor housing to the threaded end of a firearm barrel and ensuring against coaxial misalignment of a suppressor with a firearm barrel.

It is another feature of the present invention to provide a novel suppressor device having a front wall structure defining an annular array of multiple angulated gas discharge passages through which propellant gas from the secondary gas flow path is directed in angulated fashion toward the flow of gas that is emitted from a centrally located projectile port of the front wall structure.

It is also a feature of the present invention to provide a novel suppressor device having a plurality of protrusions extending forwardly from the front wall structure of the suppressor and defining slotted forward and lateral openings for reducing propellant flash.

Briefly, the various objects and features of the present invention are realized through the provision of a noise and flash suppressor device that has exceptionally large gas flow defined by a central or primary path for propellant gas propagation within the suppressor and an outer or secondary annular gas discharge path between the inner surface of a tubular suppressor housing and the external surfaces of a plurality of baffle and baffle spacer members that are positioned within the housing. A multiplicity of gas passages are defined by a housing mount structure and permit some of the propellant gas to be directed rearwardly into a gas collection chamber and then conducted forwardly through the annular gas passage that defines the secondary gas flow path.

A front wall structure is mounted to the tubular housing and defines an annular array of multiple angulated gas discharge passages which are in communication with the annular gas passage that defines the secondary gas flow path. These angulated gas discharge passages direct the supplemental propellant gas toward the centralized flow of gas being emitted from a projectile port of the front wall structure. The angulated gas discharge passages have exhaust ports that are located within an annular contoured groove of the front surface of the front wall of the suppressor so that their gas discharge is focused toward the gas flow being discharged from the centrally located projectile and gas port of the front wall structure.

In addition to having a plurality of axially spaced stacked baffle members within the elongate tubular housing of the suppressor, a propellant gas concentration chamber is defined within the forward end portion of the tubular housing by baffle-like gas concentration members having oppositely tapered walls. The structure defining the propellant gas concentration chamber also defines an annular secondary gas chamber that is a part of the secondary propellant gas flow path and is in communication with the angulated gas discharge passages of the front wall structure.

A plurality of protrusions are integral with the front wall structure of the suppressor and project forwardly to define a plurality of slots that have forward and lateral openings to reduce the flash of propellant forwardly of the suppressor device.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration showing a noise suppressor and flash hider for a firearm, being constructed and functioning according to the principles of the present invention and adapted for mounting to the muzzle end of a firearm barrel;

FIG. 2 is a front end view of the noise suppressor and flash hider of FIG. 1;

FIG. 3 is a longitudinal section view taken along line 3-3 of FIG. 2;

FIG. 4 is a partial longitudinal section view of the rear end portion of the noise suppressor and flash hider device, being enlarged to better show the components and geometry thereof;

FIG. 5 is a partial longitudinal section view of the intermediate portion of the noise suppressor and flash hider showing the internal baffles thereof in detail. and FIG. 6 is a partial longitudinal section view of the front end portion of the noise suppressor and flash hider of the noise suppressor and flash hider device of the present invention;

DETAILED DESCRIPTION OF PREFERRED EMBODIMENT

Figure 1:
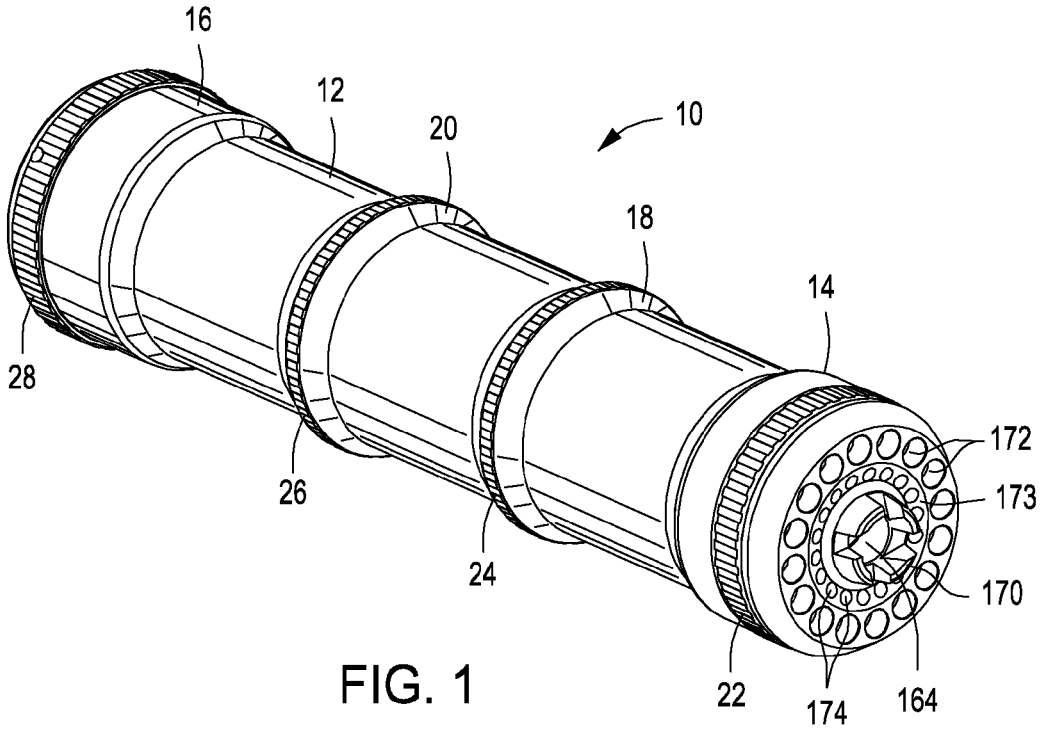
Figure 2:
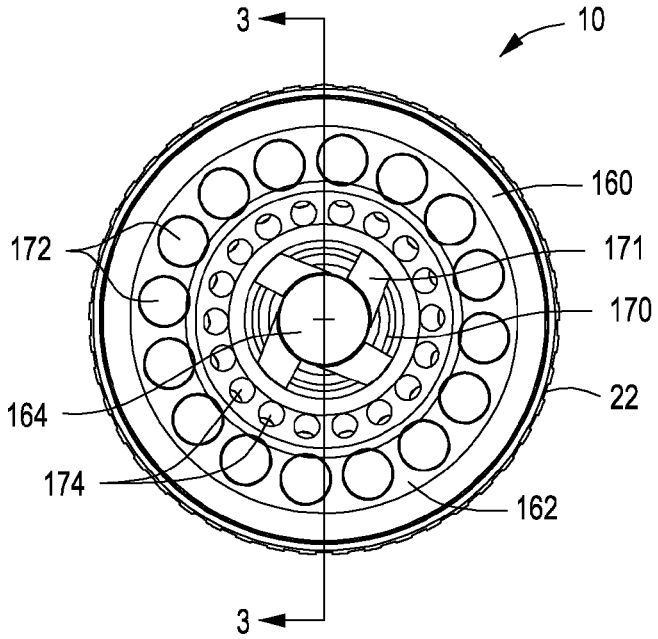
Figure 3:
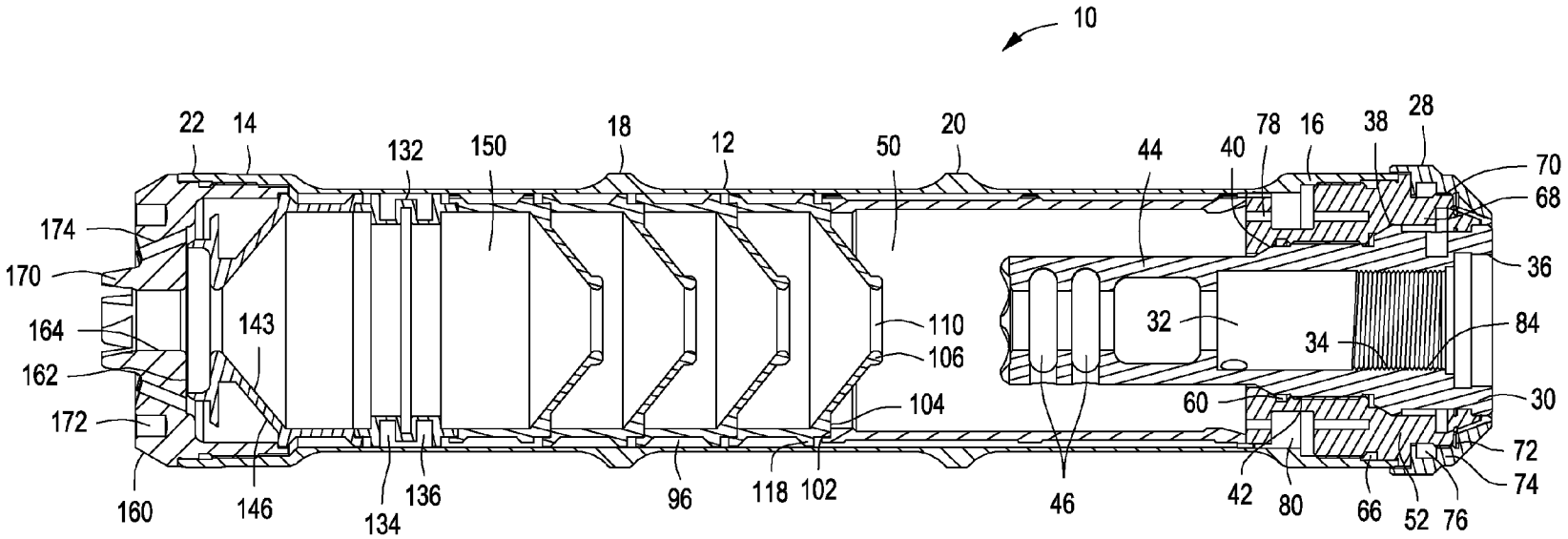
Figure 4:
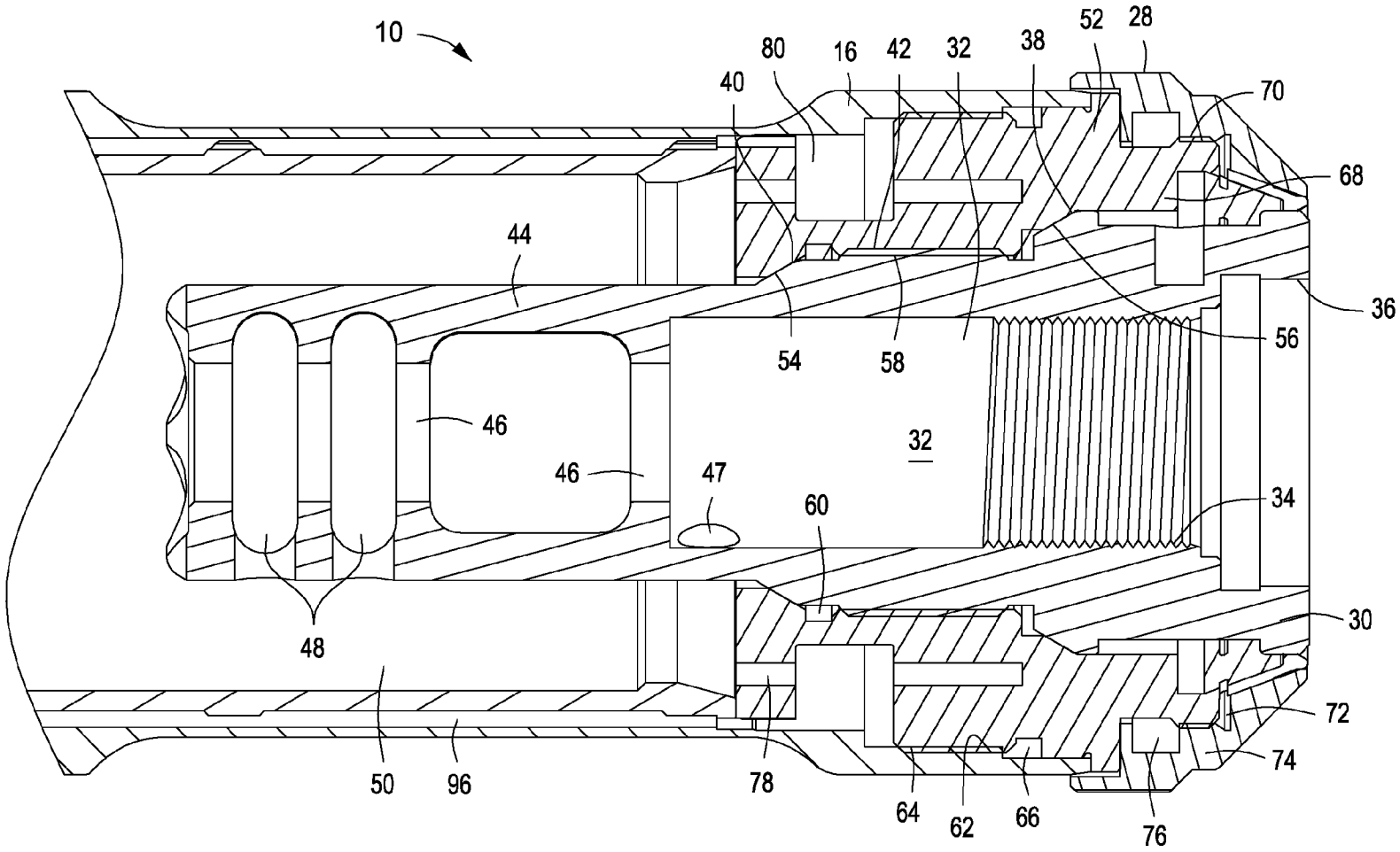
Figure 5:
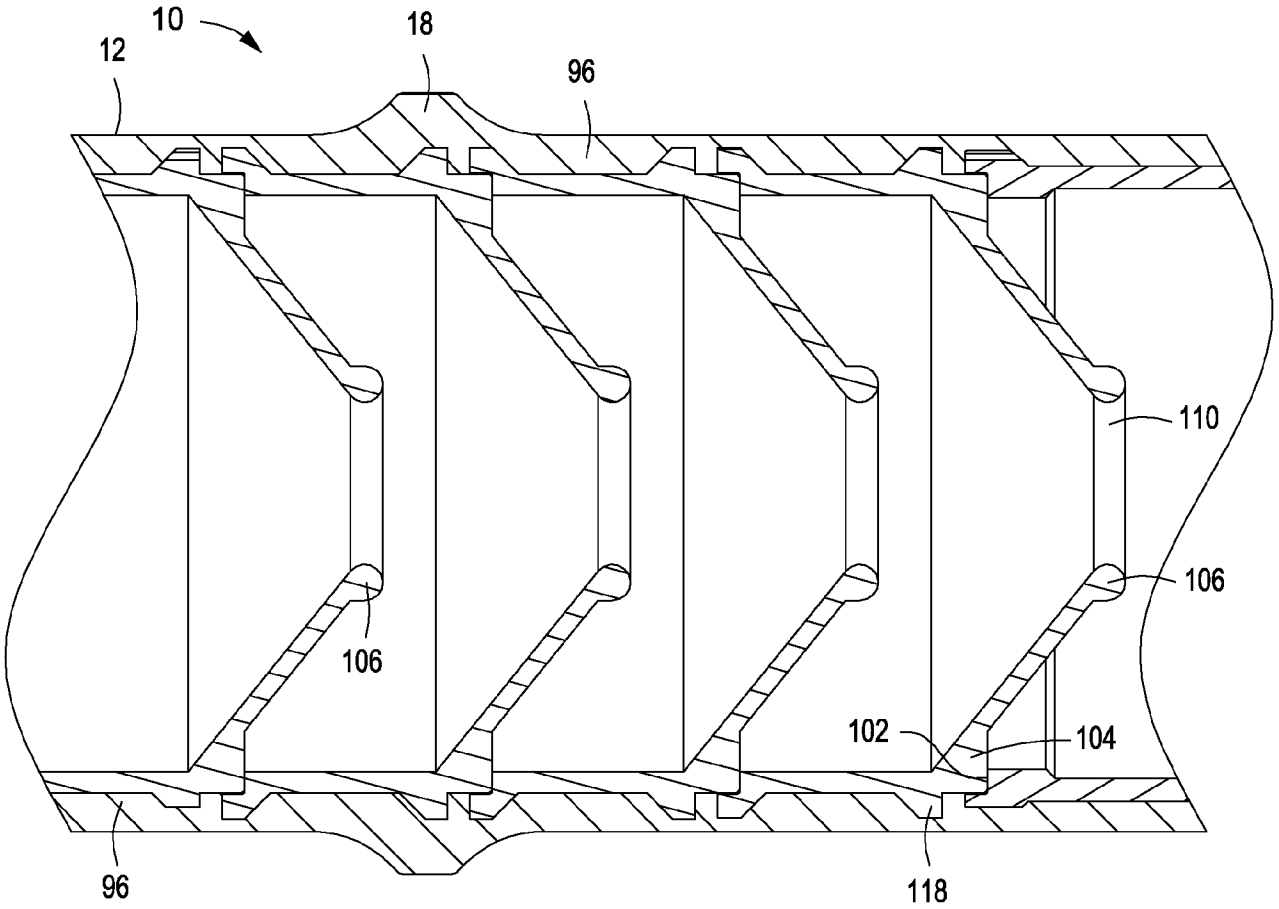
Figure 6:
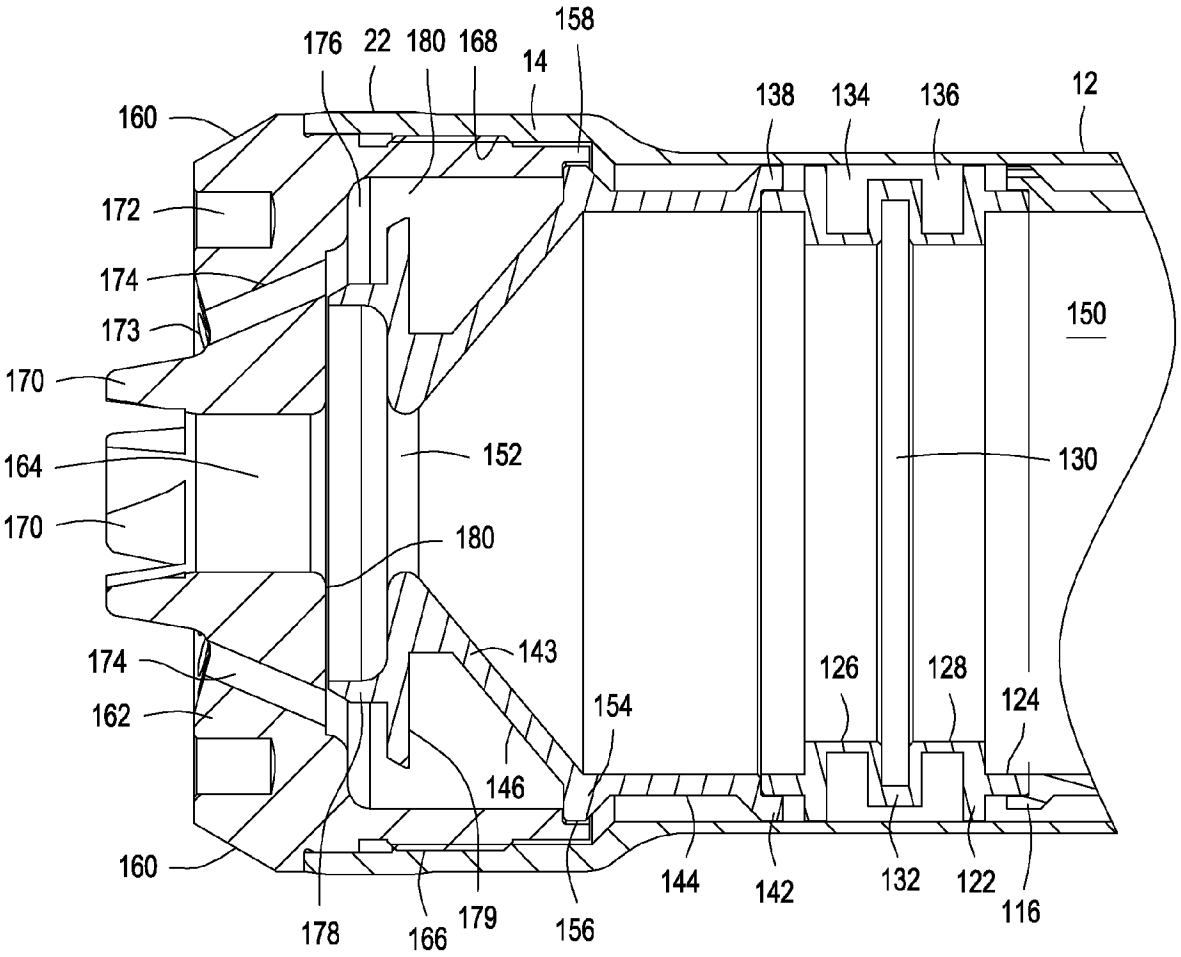

Referring now to the drawings and first to FIG. 1, a noise suppressor and flash hider device embodying the principles of the present invention is shown generally at 10 and incorporates an elongate tubular housing 12 having a defined length. The tubular housing 12 is strengthened at its forward and rear ends by generally cylindrical thickened enlarged housing wall sections 14 and 16 and is strengthened intermediate its extremities by annular external bosses 18 and 20. Circular knurled regions 22, 24 and 26 are defined by the forward enlarged housing wall section and by the intermediate annular bosses 18 and 20. Another circular knurled section 28 is provided at the rear end portion of the suppressor and flash hider assembly 10, the knurled sections being provided to facilitate secure manual grasping of the suppressor device when attaching it to and removing it from the barrel of a firearm, As shown in FIG. 3 and in greater detail in FIG. 4, a suppressor mounting structure 30 having the general form of a flash hider device and being of collet-like configuration defines a barrel end receptacle 32 having an internally threaded section 34 that is adapted to be threaded to the reduced diameter externally threaded section 35 of a firearm barrel 37 which for purposes of simplicity is shown in FIG. 4 as being separated from the suppressor mounting structure 30. The suppressor mounting structure 30 also defines a circular barrel opening geometry 36 which is of greater diameter than the externally threaded section 34 and receives the unthreaded end or muzzle portion of a firearm barrel 37 in closely fitting and suppressor stabilizing relation. The suppressor mounting structure 30 defines an external sealing section having axially spaced external annular tapered sealing surfaces 38 and 40 of differing diameter, with an externally threaded section 42 located between the annular tapered sealing surfaces.

The suppressor mounting structure 30 defines a tubular extension 44 having a plurality of internal transverse partitions that define aligned projectile ports 46 through which a bullet or other projectile that has been propelled through the bore of a firearm barrel passes when an ammunition cartridge has been fired. The wall structure of the tubular extension 44 define multiple lateral perforations such as shown at 48, permitting propellant gas to be discharged laterally from the tubular extension 44 into the first and largest of a plurality of internal compartments 50. One or more ports 47 of the tubular extension 44 communicate propellant gas from the barrel end receptacle 32 of the suppressor mounting structure 30 to the gas receiving internal compartment or chamber 50 of the suppressor device 10.

A housing mount structure 52 defines spaced internal tapered sealing surfaces 54 and 56 having an internal threaded section 58 therebetween that is engaged with the externally threaded section 42. As the internal and external threads are made up during assembly of the barrel mount 30 and the housing mount 52, the spaced internal and external sealing surfaces are forced into metal-to-metal sealing engagement to prevent propellant gas pressure from causing leakage at the tapered seals. The spaced tapered sealing surfaces of the suppressor mounting structure 30 and the housing mount structure 52 serve as a collet-like mount that adds significant structural integrity and stability for assembly of the suppressor to the threaded end of a firearm barrel. Additionally, a heat resistant annular seal member 60 is contained within an annular internal seal groove of the housing mount structure and further assists in maintaining a seal between the housing mount structure 52 and the suppressor mounting structure 30. The clamping mechanism at the rear or attachment end of the suppressor device employs a collet style system to mount the housing mount and tubular housing to the suppressor mounting structure 30. This method provides symmetrical clamping that will not tend to force the suppressor off coaxial alignment with the barrel of the firearm.

The cylindrical thickened enlarged housing wall section 16 at the rear portion of the tubular suppressor housing 12 has an internally threaded section 62 that is received by the externally threaded section 64 of the housing mount structure 52 to securely mount the tubular housing 12 to the housing mount structure. An annular seal member 66 is contained within an external seal groove of the housing mount structure and maintains sealing between the housing mount structure and the enlarged rear portion 16 of the tubular housing 12.

The housing mount structure 52 defines a rearwardly extending annular projection 68 having an external threaded section 70 that receives an internally threaded section 72 of a rear cap member 74 of the suppressor. An annular seal member 76 is contained within an annular internal seal groove of the rear cap member 74 and maintains sealing of the rear cap member with the housing mount structure.

As mentioned above, noise suppressors for firearms typically function by dissipating propellant gas pressure emitted from the muzzle of a firearm barrel by permitting controlled expansion of the propellant gas and dissipating dissipation of propellant gas pressure over a period of time, referred to as dwell time. Suppression of the propellant gas in this manner converts the sharp firearm report to a softer sound. As the propellant gas energized cycling mechanism begins to extract a spent cartridge case from the cartridge chamber of the firearm, virtually all of the propellant gas will have been dissipated. However, the suppressor can contain a bit of residual gas pressure which is released from the cartridge chamber past the cartridge case that is being extracted, permitting a small amount of propellant gas to be directed toward the user of the firearm. It is desirable, according to the principles of the present invention to virtually completely dissipate the propellant gas within the suppressor before gas energized extraction of the spent cartridge case begins, this virtually eliminating direction of propellant gas and residue toward the user of the firearm.

According to the present invention propellant gas from the muzzle of a firearm is directed in serial fashion through a primary suppressor gas discharge path having multiple internal chambers that are defined by the internal baffles and baffle spacers within a suppressor. A secondary or supplemental path of propellant gas discharge is defined by the internal surface of a tubular suppressor housing and by spacing of the external surfaces of baffle and baffle spacer members with the internal housing surface. The secondary or supplemental path of propellant gas discharge is relatively thin, but extends substantially along the entirety of the inner generally cylindrical surface of the suppressor housing. Consequently, the secondary or supplemental path has substantial volume and, together with the primary suppressor gas discharge path, causes rapid gas pressure dissipation of the suppressor and minimizes the potential for propellant gas blow-back when a spent cartridge case is unseated from the cartridge chamber.

The housing mount structure 52 defines multiple propellant gas passages 78 permitting a substantial volume of propellant gas to flow rearwardly from the first of the internal compartments 50 to an annular secondary gas collection chamber 80 that is defined by the housing mount structure and the cylindrical thickened enlarged housing wall section 16 of the tubular housing 12. The tubular housing 12 defines a generally cylindrical internal wall surface 82 that is disposed in annular spaced relation with an annular outer peripheral surface 84 of the housing mount structure thereby defining an annular gas passage opening 86.

The forward end of the housing mount structure 52 defines an annular stop shoulder 88 that is engaged by the rear end 90 of a tubular spacer member 92 that is centralized within the housing chamber by its engagement with the housing mount with its external surface 94 disposed in spaced relation with the inner cylindrical surface of the housing member, thereby defining an annular gas flow path 96 from the secondary gas collection chamber 80 forwardly along the inner cylindrical surface 82 of the tubular housing member. The tubular spacer member defines one or more circular external enlargements 96 that face the internal cylindrical surface 82 of the tubular housing 12 and serve to contact the internal cylindrical surface of the tubular housing and maintain the spaced relation of the tubular spacer member 92 and the internal surface 82 of the housing 12. The circular external enlargements 98 of the spacer member 92 can be slotted externally to ensure that the flow path 96 remains open at all times.

At its forward end the generally cylindrical wall of the spacer member 92 defines a circular enlargement 100 having an internal circular seat recess 102 within which is seated the circular rear end portion 104 of the first of a plurality of baffle members 106. Each baffle member 106 defines a generally conical wall 108 having a projectile port 110 centrally thereof which is aligned with the projectile ports 46 of the tubular extension 44 of the suppressor mounting structure 30 and is aligned with the projectile ports of other baffle members. Each of the baffle members 106 also defines a generally cylindrical wall section 112 having a forward enlargement 114 defining a circular internal baffle seat 116 and having a rear generally circular external enlargement or ridge 118. The generally circular external ridge 118 is slotted externally to define a multiplicity of gas flow grooves 120 that ensure the flow of a portion of the propellant gas through the flow path or space 96 between the internal wall surface 82 of the tubular housing 12 and the external wall surfaces of the spacer members and the baffle members.

Ahead of the last baffle member 106 and within the tubular housing is provided a gas turbulence member 122 having a generally cylindrical rearward projection 124 that is engaged within the annular internal seat 116 of the forward-most baffle member 106. The gas turbulence member 122 defines a wall geometry having grooves and ridges of serpentine configuration which create turbulence in the propellant gas flow from the projectile port 110 of the forward-most baffle member. The wall geometry of the gas turbulence member 122 defines internal generally circular wall projections 126 and 128 that are separated by an internal generally circular groove 130 that is defined by an outwardly projecting generally circular wall section or ridge 132. This serpentine wall configuration defines external generally circular grooves 134 and 136 and the external intermediate circular ridge 132 that are exposed to the external gas flow path 96 and creates turbulence that dissipates the energy of the flowing propellant gas. Thus, the serpentine wall structure of the gas turbulence member 122 creates gas turbulence in the internal and external gas flow paths with the turbulence serving to suppress the loud and sharp noise that would otherwise be emitted from the barrel of the firearm.

The forward end of the gas turbulence member 122 defines a forwardly projecting circular positioning rim 138 that is received within an internal generally circular positioning recess 140 that is defined by an annular enlargement 142 at the rear portion of a generally cylindrical wall member 144 of a propellant gas concentration member 146. The annular enlargement 142 is slotted externally to define a multiplicity of flow slots that conduct propellant gas of the external flow path 96 past the annular enlargement 142 and also serve to further dissipate the energy of the flowing propellant gas during transition of the propellant gas through the external flow path 96. The propellant gas concentration member 146 defines a generally conical wall structure 148 that serves to concentrate propellant gas entering a final internal chamber 150 from the projectile port 110 of the last baffle member. The conical wall 148 concentrates and directs the propellant gas from the internal chamber 150 through a centrally located projectile port 152 of the conical wall.

An annular location shoulder 154 is defined by the propellant gas concentration member 146 and is received by an annular internal seat member 156 that is defined at the rear end portion of a generally cylindrical rearwardly projecting wall 158 of a front closure member 160. The front closure member or cap 160 defines a front wall structure 162 having a centrally located projectile port 164. The rearwardly projecting wall 158 defines an externally threaded section 166 that is disposed in threaded engagement with an internally threaded section 168 of the forward generally cylindrical thickened enlarged housing wall section 14. A plurality of spaced projections 170 of flash reducing geometry extend forwardly from the front wall 162 of the front closure member 160 and define slots 171 that open forwardly and laterally to direct exhaust gas forwardly and laterally. A circular array of recesses 172 are formed in the front wall 162 and serve to eliminate some of the material of the front wall structure. The recesses 172 also provide for engagement of a spanner type tool with the front wall structure if needed to rotate the front closure member during assembly and disassembly of the suppressor mechanism. Multiple angulated gas exhaust passages 174 are formed in the front wall structure 162 and have communication with an internal annular gas conducting chamber 176 that is defined by contact of a circular rim 178 of the propellant gas concentration member 146 with a generally planar rear surface 180 of the front wall structure 162. The exhaust passages 174 terminate at exhaust openings that are located within an annular contoured depression or groove 173.

Operation:

When a firearm having the suppressor 10 mounted to the barrel thereof is fired, after the projectile has passed a barrel port of the barrel, a portion of the propellant gas pressure passes through the barrel port into the gas block of the gas handling system. The propellant gas is employed by the auto-cycle mechanism of the firearm to initiate gas energized movement of a bolt carrier and bolt assembly which, after a period of time, will unlock the bolt member and retract the bolt carrier and bolt against the force of a buffer spring to extract a spent cartridge case from the cartridge chamber of the barrel of the firearm.

After the projectile has been propelled clear of the muzzle of the firearm barrel by the force the propellant gas, the projectile will pass through the aligned projectile ports of the tubular extension 44 of the suppressor mounting structure 30, which is generally in the form of a flash hider device. The projectile will then continue its propellant gas energized movement through the aligned projectile ports of each of the internal baffles 106 of the suppressor 10 and through the serially arranged compartments that are defined by the spaced baffles. The projectile will then continue its flight through the gas concentration compartment 150 and will pass through the projectile port 152 of the generally conical propellant gas concentration member 146 and will pass through the projectile exit port 164 of the front closure member 160 and will continue its trajectory flight to the intended target.

Propellant gas from the bore of the firearm barrel will enter the barrel end receptacle 32 of the suppressor mount structure 30 at high pressure. Most of the propellant gas will proceed along a primary flow path through the first of the projectile ports 36 of the suppressor mount and a part of the propellant gas will be directed from the barrel end receptacle 32 through the ports 47 into the rearmost region of the first compartment 50. The propellant gas will continue its progression into the first of the compartments 50 via the projectile ports 46 and the lateral ports 48 of the tubular extension 44 of the suppressor mount 30.

A portion of the propellant gas will be diverted from the rearmost region of the first chamber 50 to the external or secondary flow path by passing rearwardly through the multiple flow ports 78 of the housing mount 68 into the annular gas collection chamber 80. The gas of the annular chamber 80 then enters an annular secondary flow path that is defined by the spaced relation of the inner cylindrical surface 82 of the tubular housing 12 and the outer peripheral surfaces of the baffle members and spacer members that are contained in longitudinally stacked relation within the internal chamber of the tubular housing. The propellant gas then progresses forwardly through the cylindrical space of the secondary flow path to an annular secondary gas chamber 180 that is defined by the front end portion including the conical wall structure 148 and the planar wall structure 149 and circular rim 178 and planar wall 179 of the propellant gas concentration member 146. From the annular secondary gas chamber 180 the propellant gas from the secondary flow path passes through a generally circular array of multiple angulated gas exhaust passages 174 which direct the secondary exhaust gas so as to impinge with the primary exhaust gas being exhausted from the projectile port 164.

The additional volume of secondary propellant gas afforded by the thin but large volume of the secondary flow path added to the propellant gas flowing in serpentine fashion from the multiple internal chambers 50 vis the projectile ports of the generally conical baffle members materially minimizes the dwell time of residual propellant gas pressure within the suppressor device and ensures virtually complete dissipation of propellant gas pressure within the suppressor at the time the auto-cycle mechanism of the firearm begins to extract a spent cartridge case from the cartridge chamber of the firearm barrel. Thus, virtually no propellant gas will blow back toward the user of the firearm, resulting in more comfortable firearm shooting conditions for the user. The enhanced volume of propellant gas exhaust from the suppressor device establishes enhanced noise suppression with minimum dwell time for complete gas exhaustion as compared with conventional suppressor devices.

The noise suppressor of the present invention is simply and efficiently mounted to a firearm barrel 37 by engaging the external threads 35 of a firearm barrel with the internal threaded section 34 within the suppressor mounting structure 30. The firearm user will grip the external knurled ridges 22-28 along the length of the tubular housing and rotate the suppressor to make up the threaded connection with the firearm barrel. When the threaded connection is secure the firearm may be used in normal fashion. If desired, a gripping tool may be applied to the external knurling, preferably nearest the barrel of the firearm to apply sufficient rotational force to cause complete tightening of threaded connection of the suppressor to the threaded end of the firearm barrel. Removal of the suppressor 10 from the threaded end of the firearm barrel is accomplished in similar manner, by applying sufficient rotational force to break the tightness of the threaded connection and continuing to rotate the suppressor housing until the suppressor mount is completely unthreaded from the firearm barrel.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A noise suppressor and flash hider device for mounting to the externally threaded end of a firearm barrel, comprising:

an elongate tubular housing defining front and rear extremities and having an internal housing surface;

a suppressor mount being located at said rear extremity of said elongate tubular housing and having an internally threaded section receiving the externally threaded section at the muzzle end of a firearm barrel;

a plurality of baffle members being located within said elongate tubular housing and defining a primary flow path for propellant gas having a plurality of serially arranged internal propellant gas chambers, said baffle members each having an aligned projectile port through which projectiles move and through which propellant gas also flows, said baffle members each having an outer wall disposed in circumferentially spaced relation with said internal housing surface and defining a secondary flow path for propellant gas; and a front wall being mounted to said elongate tubular housing and defining a projectile and propellant gas exit port centrally thereof, said front wall defining a propellant gas exhaust port in communication with said secondary flow path and exhausting propellant gas from said secondary flow path.

2. The noise suppressor and flash hider device of claim 1, comprising:

said suppressor mount having a barrel mount section defining said internally threaded section and having an externally tapered surface and an externally threaded section; and said suppressor mount having a housing mount section being secured to said elongate tubular housing and having an internally tapered surface disposed in aligning engagement with said externally tapered surface and having an internally threaded section in retaining engagement with said externally threaded section.

3. The noise suppressor and flash hider device of claim 1, comprising:

said suppressor mount having a barrel mount section having spaced externally tapered surfaces and an externally threaded section between said spaced externally tapered surfaces;

said suppressor mount having a housing mount section being secured to said rear extremity of said elongate tubular housing and having spaced internally tapered surfaces disposed in aligning engagement with said spaced externally tapered surfaces and having an internally threaded section in retaining engagement with said externally threaded section; and wherein said barrel mount and said housing mount are axially aligned by said housing mount and said barrel mount and maintain coaxial alignment of said noise suppressor and flash hider device with the firearm barrel to which it is attached.

4. The noise suppressor and flash hider device of claim 1, comprising:

said housing mount section of said suppressor mount and said elongate tubular housing defining a secondary gas collection chamber receiving propellant gas from said primary gas flow path and being in propellant gas conducting relation with said secondary propellant gas flow path.

5. The noise suppressor and flash hider device of claim 4, comprising:

said housing mount section of said suppressor mount having a plurality of propellant gas passages extending rearwardly from said primary gas flow path to said secondary gas collection chamber.

6. The noise suppressor and flash hider device of claim 1, comprising:

said front wall defining a front wall surface and having a plurality of propellant gas exhaust passages each in communication with said secondary propellant flow path and having passage exhaust openings at said front wall surface.

7. The noise suppressor and flash hider device of claim 6, comprising:

said plurality of propellant gas exhaust passages being of angulated orientation and having exhaust ports arranged in a substantially circular array and directing propellant gas exhaust from said secondary flow path to converge with propellant gas being discharged from said projectile and propellant gas exit port.

8. The noise suppressor and flash hider device of claim 1, comprising:

a tapered gas concentration member being located within said elongate tubular housing and having a projectile port centrally thereof, said tapered gas concentration member defining an annular secondary gas chamber within said elongate tubular housing in communication with said secondary flow path;

a projectile exit port being defined centrally of said front wall;

an external generally circular contoured groove being defined by said front wall about said projectile exit port; and a plurality of propellant gas exhaust passages extending through said front wall and having outlet openings within said external generally circular contoured groove, said plurality of propellant gas exhaust passages being in communication with said annular secondary gas chamber.

9. A noise suppressor and flash hider device for mounting to the externally threaded end of a firearm barrel, comprising:

an elongate tubular housing defining front and rear extremities and having a generally cylindrical internal housing surface;

a suppressor mount being located at said rear extremity of said elongate tubular housing and having an internally threaded section receiving the externally threaded section of a firearm barrel;

a plurality of baffle members being located within said elongate tubular housing and defining a primary flow path for propellant gas and defining a plurality of serially arranged internal propellant gas chambers, said baffle members each having an aligned projectile port through which projectiles move and through which propellant gas also flows, said baffle members each having an outer generally cylindrical wall disposed in circumferentially spaced relation with said internal housing surface and defining a generally cylindrical secondary flow path for propellant gas; and a front wall being mounted to said elongate tubular housing and defining a projectile and propellant gas exit port centrally thereof, said front wall defining a generally annular array propellant gas exhaust ports surrounding said projectile and propellant gas exit port and being in communication with said secondary flow path and exhausting propellant gas from said secondary flow path through said front wall.

10. The noise suppressor and flash hider device of claim 9, comprising:

said suppressor mount having a barrel mount section defining said internally threaded section and having axially spaced externally tapered surfaces and an externally threaded section between said axially spaced externally tapered surfaces; and said suppressor mount having a housing mount section being secured to said elongate tubular housing and having axially spaced internally tapered surfaces disposed in aligning engagement with said axially spaced externally tapered surfaces and having an internally threaded section in retaining engagement with said externally threaded section.

11. The noise suppressor and flash hider device of claim 9, comprising:

said suppressor mount having a barrel mount section defining axially spaced externally tapered surfaces of different diameter and an externally threaded section between said axially spaced externally tapered surfaces;

said suppressor mount having a housing mount section being secured to said rear extremity of said elongate tubular housing and having axially spaced internally tapered surfaces disposed in aligning engagement with said axially spaced externally tapered surfaces and having an internally threaded section in retaining engagement with said externally threaded section; and wherein said barrel mount and said housing mount are axially aligned by said housing mount and said barrel mount and maintain coaxial alignment of said noise suppressor and flash hider device with the firearm barrel to which it is attached.

12. The noise suppressor and flash hider device of claim 9, comprising:

said housing mount section of said suppressor mount and said elongate tubular housing defining a secondary gas collection chamber receiving propellant gas from said primary gas flow path and being in propellant gas conducting relation with said secondary propellant gas flow path; and said housing mount section of said suppressor mount having a plurality of propellant gas passages extending rearwardly from said primary gas flow path to said secondary gas collection chamber.

13. The noise suppressor and flash hider device of claim 9, comprising:

said front wall defining a front wall surface and having a plurality of propellant gas exhaust passages of angulated orientation each being in communication with said secondary propellant flow path and having propellant gas exhaust openings at said front wall surface.

14. The noise suppressor and flash hider device of claim 13, comprising:

a generally circular contoured depression being defined by said front wall and being located about said projectile and primary exhaust gas port; and said plurality of propellant gas exhaust passages being of angulated orientation and having exhaust ports arranged in a substantially circular array within said generally circular contoured depression and directing propellant gas exhaust from said secondary flow path to converge with propellant gas being discharged from said projectile and propellant gas exit port.

15. The noise suppressor and flash hider device of claim 9, comprising:

a tapered gas concentration member being located within said elongate tubular housing and having a projectile port centrally thereof, said tapered gas concentration member defining an annular secondary gas chamber within said elongate tubular housing in communication with said secondary flow path;

a projectile exit port being defined centrally of said front wall;

an external generally circular contoured groove being defined by said front wall about said projectile exit port; and a plurality of propellant gas exhaust passages extending through said front wall and having outlet openings within said external generally circular contoured groove, said plurality of propellant gas exhaust passages being in communication with said annular secondary gas chamber.

* * * * *